United States Patent [19]

Contreras, Sr.

[11] Patent Number: 4,693,392

[45] Date of Patent: Sep. 15, 1987

[54] HINGE, AND BOSS ASSEMBLY FOR CLOSURE MEMBERS

[76] Inventor: Joseph P. Contreras, Sr., 6 Brockden Dr., Mendham, N.J. 07945

[21] Appl. No.: 907,483

[22] Filed: Sep. 15, 1986

[51] Int. Cl.[4] ..... B65D 43/14; B65D 51/04

[52] U.S. Cl. ..... 220/343; 220/335; 220/337

[58] Field of Search ..... 220/334, 335, 337, 342, 220/343

[56] References Cited

U.S. PATENT DOCUMENTS 2,737,189 3/1956 Morningstar et al. ..... 220/343

4,349,120 9/1982 NiNardo ..... 220/337

*Primary Examiner*—George T. Hall

*Attorney, Agent, or Firm*—Daniel H. Bobis

[57] ABSTRACT

A spring latch, hinge and boss assembly for closure members generally on containers such as compacts for powder and other cosmetics includes, spaced hinge elements on one peripheral side of the closure or cover member and base member to permit pivotal movement of the closure or cover member from open to closed position and vice versa relative to the base member and a boss member disposed between the hinge elements so that a force must be exerted on the closure member during closing movement. The materials of the boss member are harder than the material for the closure member and the base member. The boss member is constructed with a designed resistance to closing and to opening of the closure member relative to the base member. Alternatively and selectively and even though made of a harder material the boss can be designed so that in assembled position it can be rigid and non-yielding or can flex depending on the materials selected for the closure member, base member and boss and the shape of the boss member. The closing and opening movement of the closure member produces and audible clicking sound under coaction with the boss member.

26 Claims, 59 Drawing Figures

HINGE, AND BOSS ASSEMBLY FOR CLOSURE MEMBERS

BACKGROUND OF THE INVENTION

This invention relates generally to closure members such as closure members on compacts for cosmetics or other containers and more particularly to a combined hinge and boss assembly for pivotally connecting such closure members into operating position which offers a designed resistance to the movement of such closure member from closed to opened position and vice versa.

Compacts for powder, rouge and other cosmetics are well known devices and conventional prior art compacts have the closure or cover member pivotally hinged to the base member for movement of the cover member from opened to closed position so that they require a conventional interference type clasp unit for sealing the closure or cover member to the base member which interference clasp unit will be located a spaced distance generally opposite from the pivotal hinge means provided on the compact.

Various prior art containers for use as compacts or vanity cases are known wherein the pivotal hinge means and the clasp or latching assembly are disposed at the same side or edge of the compact as is shown in U.S. Pat. Nos. 2,527,318 and 2,404,558.

In U.S. Pat. No. 4,345,607, a spring latch and hinge mechanism for compacts or other containers establishes design forces to provide a predetermined pressure for maintaining the compact in the closed position, and a designed resistance to the closing and to the opening of the closure or cover member with respect to the associated base member on which the closure member is pivotally connected. This is accomplished by taking advantage of the inherent strength and thermal memory of the plastic materials from which the compacts are molded.

The present invention provides a unique and improved latch mechanism for compacts or other containers in which a boss member is disposed relative the hinge mechanism so as to advantageously utilize the force that must be exerted on the closure member during closing movement and during opening movement relative to the base member. The boss member is made of a material that is generally harder than the material for the closure member and the base member. The boss member can be formed so that in assembled position it is either essentially rigid and non-resilient and therefore will not yield on closing movement of the closure means on the compact or containers or alternatively the boss member can be formed so that it will readily flex on closing movement of the closure member. The nature of the functions of the boss member that is whether rigid or flexible will permit a wide range of closing variations in accordance with the present invention depending on the application or use for any given compact or container.

SUMMARY AND OBJECTS OF THE INVENTION

Thus, the present invention covers an improved hinge and boss assembly for the closure means on a compact or container having, a base member including spaced hinge means having hinge elements respectively on the closure means and the base member and a boss member disposed relative to and for coacting with the hinge means. The boss member is of a generally harder material than the pivotally connected closure member and base member and is operatively disposed for coaction with groove means in the closure means so as to provide a predetermined resistance to closing during movement of the closure member to the closed position and to provide a predetermined resistance to opening movement of the closure member from the closed position, said boss means alternatively and selectively sized and shaped to provide a predetermined range of resiliency from rigid and non-yielding to readily flexible as required for the application and use of the compact or container.

Accordingly, it is the principal object of the present invention to provide an improved hinge and boss assembly for a compact or container in which the resiliency of the boss member provides a means for varying the resistance to closing; the resistance to opening, and the forces for maintaining the closure member for the compact or container closed.

It is another object of the present invention to provide an improved hinge and boss assembly for a compact or container in which the boss member is made of a generally harder material than the base member and the pivotally connected closure member of the compact or container, and the boss member can be formed and shaped so as to regulate the degree of resiliency thereof from very rigid to very flexible, depending on the application and use of the compact or container.

It is another object of the present invention to provide a container having an improved hinge and boss assembly which requires a predetermined force to move the closure member of the container to the closed position and has a designed resistance to the opening of the closure without requiring the use of a conventional interference clasp of any kind.

It is another object of the present invention to provide a container having an improved hinge and boss assembly wherein said boss member includes, undercut portions which will flex when a predetermined force is exerted during closing movement of the closure member, thus relieving any undue stress from being exerted on said closure member and hinge assembly.

It is another object of the present invention to provide an improved hinge and boss assembly for the closure on a container or an associated base wherein on movement to the open position an audible click or snap occurs during the use of the container.

Other objects and advantages of the present invention will become apparent from the following description taken in conjunction with accompanying drawings showing several embodiments of the invention in which:

Figure 1:
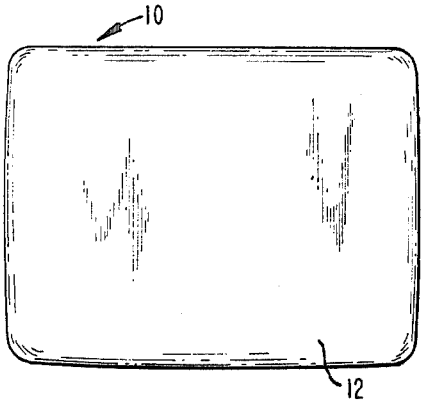
FIG. 1—is a top plan view of a compact in accordance with the present invention.
Figure 2:
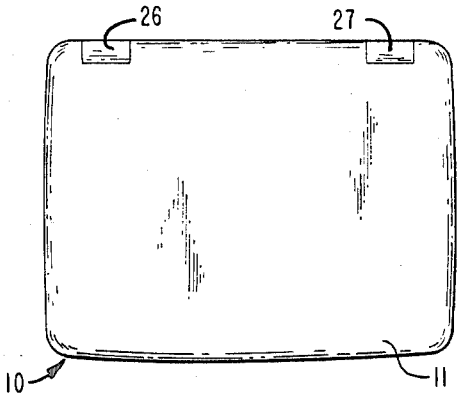
FIG. 2—is a bottom plan view of the compact shown in FIG. 1.
Figure 3:
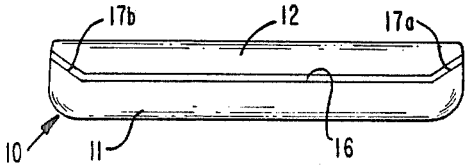
FIG. 3—is a front elevational view of the compact shown in FIG. 1.
Figure 4:
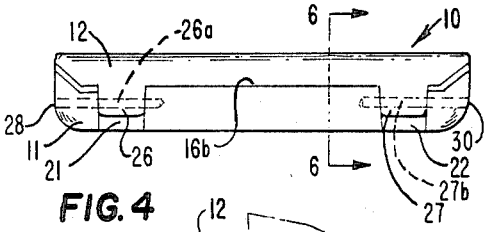
FIG. 4—is a rear elevational view of the compact shown in FIG. 1.
Figure 5:
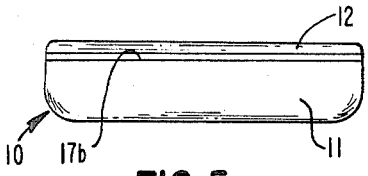
FIG. 5—is a side elevational view of the compact shown in FIG. 1.
Figure 7:
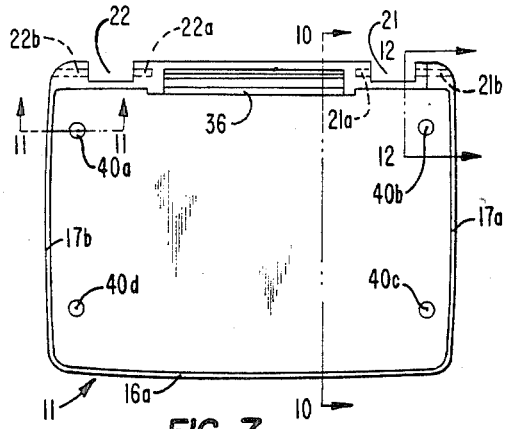

FIG. 7—is a top plan view of the base member for the compact shown in FIG. 1.

Figure 8:
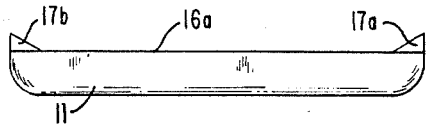

FIG. 8—is a front elevational view of the base member shown in FIG. 7.

Figure 9:
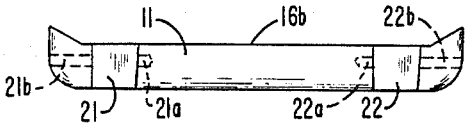

FIG. 9—is a rear elevational view of the base member shown in FIG. 7.

Figure 10:
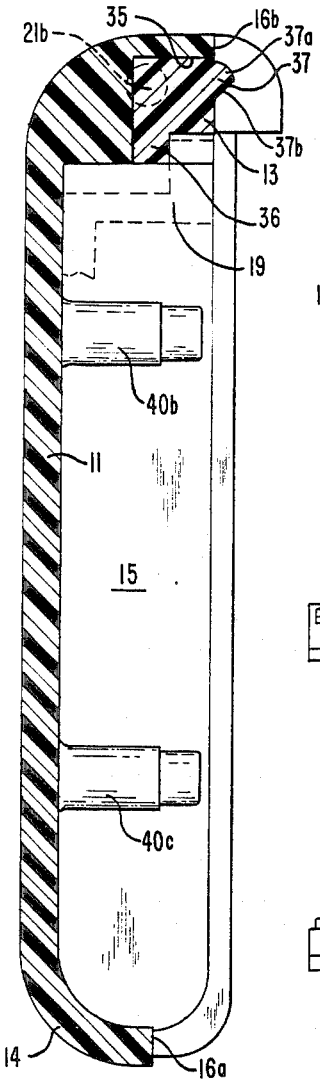

FIG. 10—is a cross-section taken on line 10—10 of FIG. 7, with a fragment of the cover assembly shown in phantomized lines.

Figure 11:
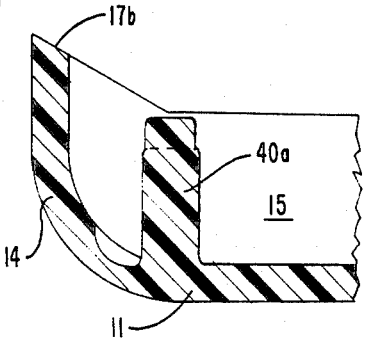

FIG. 11—is a cross-section taken on line 11—11 of FIG. 7.

Figure 12:
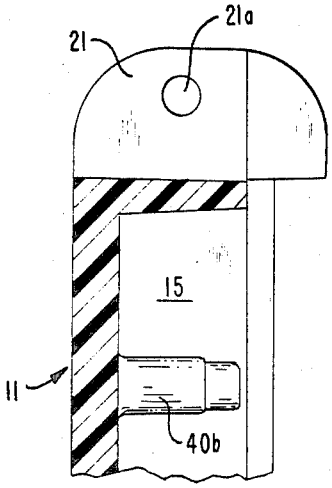

FIG. 12—is a cross-section taken on line 12—12 of FIG. 7.

Figure 13:
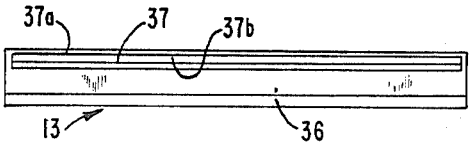

FIG. 13—is a top view of the boss member shown in FIG. 7.

Figure 14:
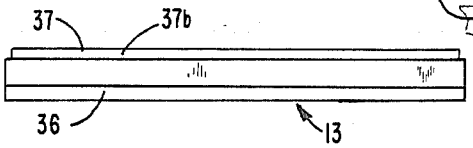

FIG. 14—is a front view of the boss member shown in FIG. 7.

Figure 15:
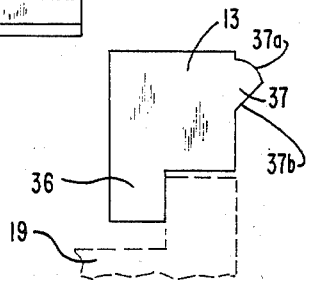

FIG. 15—is a side view of the boss member shown in FIG. 7.

Figure 16:
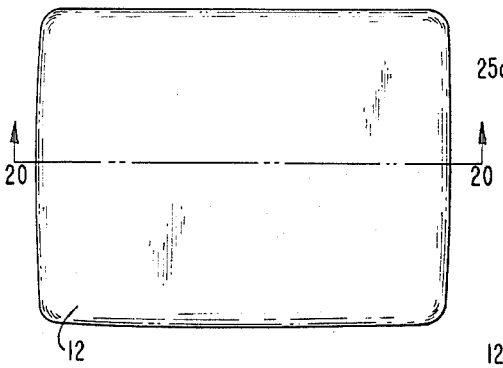

FIG. 16—is a top plan view of the cover member from the compact shown in FIG. 1.

Figure 17:
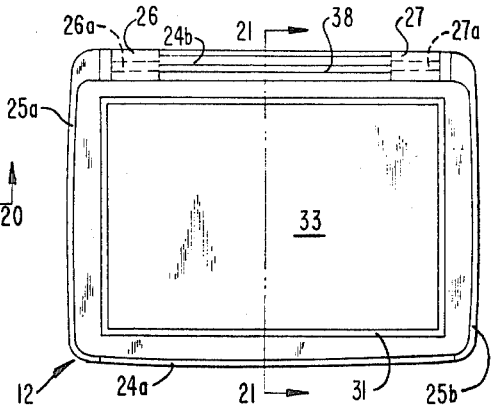

FIG. 17—is a bottom plan view of the cover member shown in FIG. 16.

Figure 18:
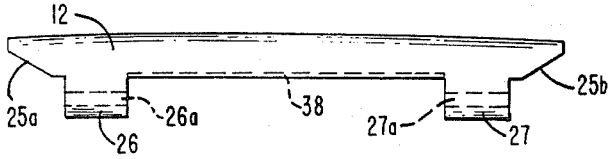

FIG. 18—is a rear elevational view of the cover member shown in FIG. 16.

Figure 19:
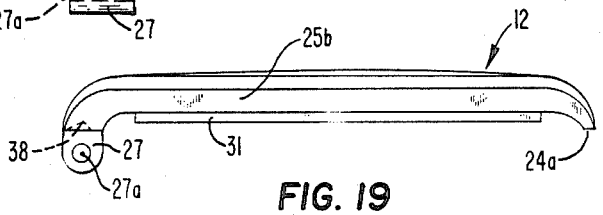

FIG. 19—is a side view of the cover member shown in FIG. 16.

Figure 20:
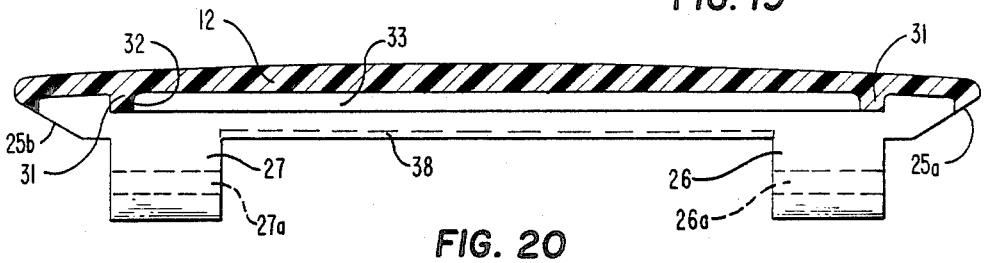

FIG. 20—is a cross-sectional taken on line 20—20 of FIG. 16.

Figure 21:
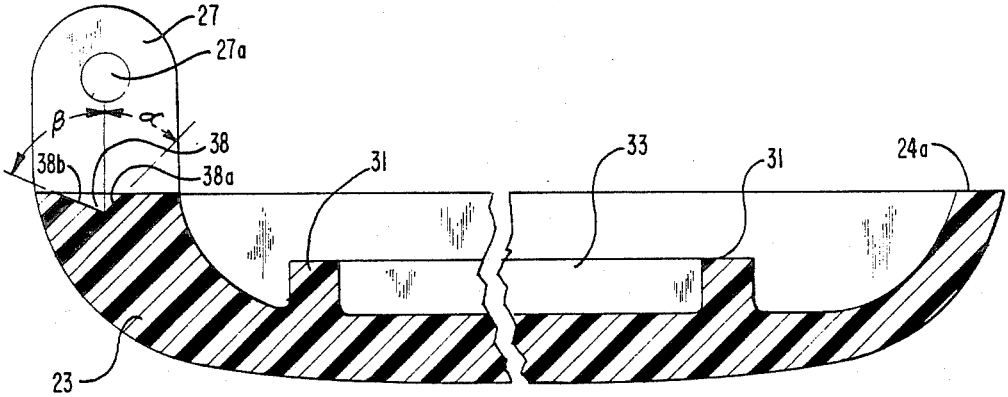

FIG. 21—is a cross-section taken on line 21—21 of FIG. 17.

Figure 22:
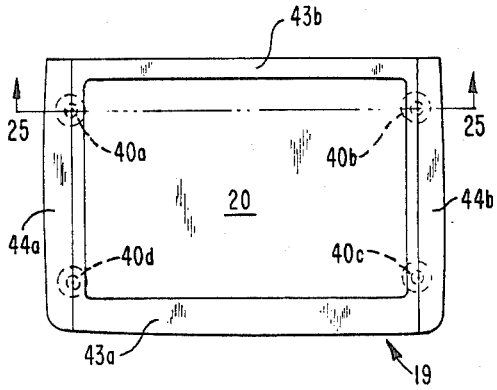

FIG. 22—is a top plan view of the platform member for the compact shown in FIG. 1.

Figure 23:
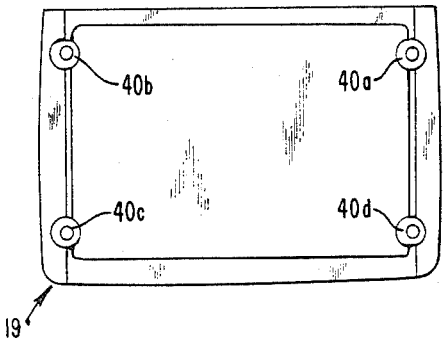

FIG. 23—is a bottom plan view of the platform member shown in FIG. 22.

Figure 24:
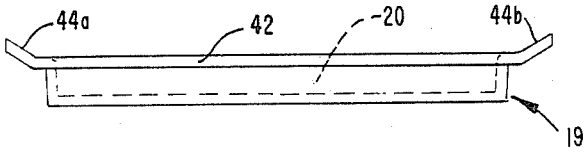

FIG. 24—is a front elevational view of the platform member in FIG. 22 with the material chamber shown in dotted lines thereon.

Figure 25:
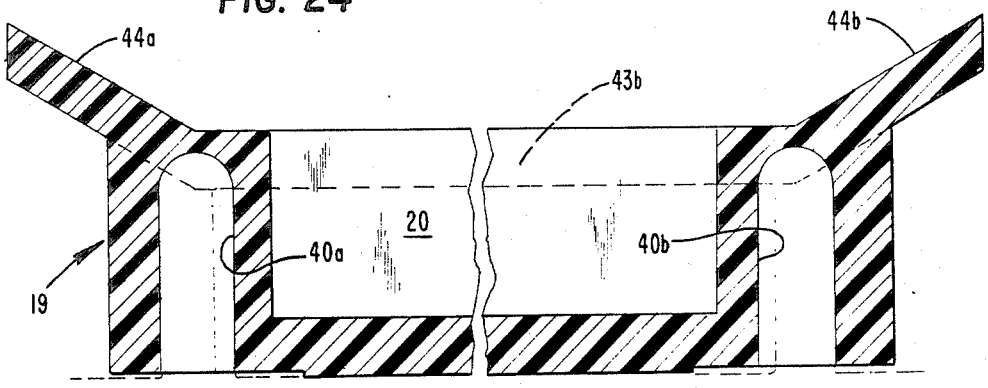

FIG. 25—is a cross-section taken on line 25—25 of FIG. 22.

Figure 26:
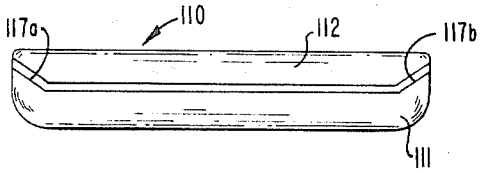

FIG. 26—is a front view of a compact in accordance with another form of the invention.

Figure 27:
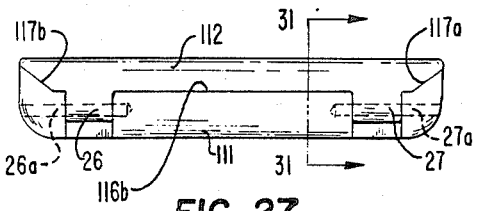

FIG. 27—is a rear view of the compact in accordance with the form of the invention shown in FIG. 16.

Figure 28:
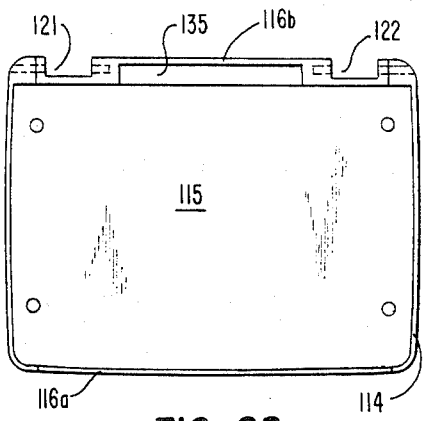

FIG. 28—is a top plan view of the base member for the compact in accordance with the form of the invention shown in FIG. 26.

Figure 28A:
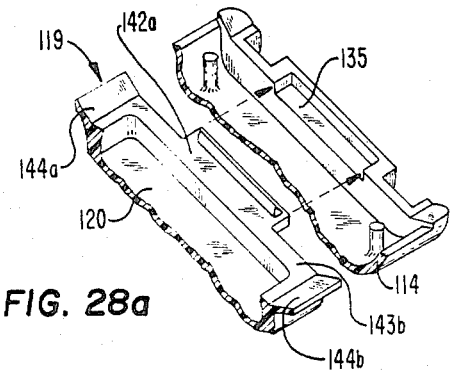

FIG. 28*a*—is a fragmentary exploded view of the platform member and the base member for the compact in accordance with the form of the invention shown in FIGS. 26 to 28.

Figure 29:
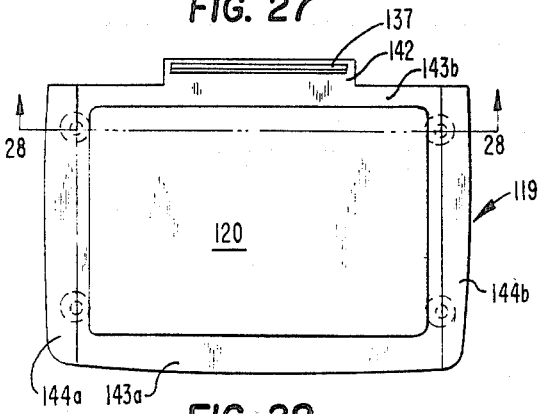

FIG. 29—is a top plan view of the platform member for the compact in accordance with the form of the invention shown in FIGS. 26 to 28*a*.

Figure 30:
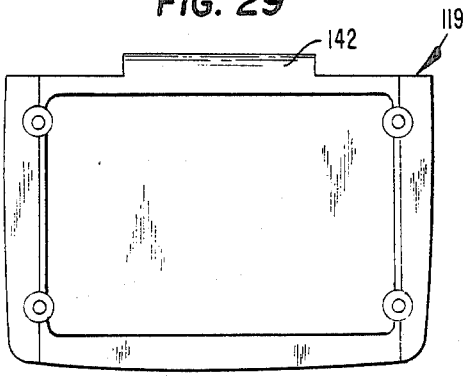

FIG. 30—is a bottom plan view of the platform member shown in FIG. 29.

Figure 31A:
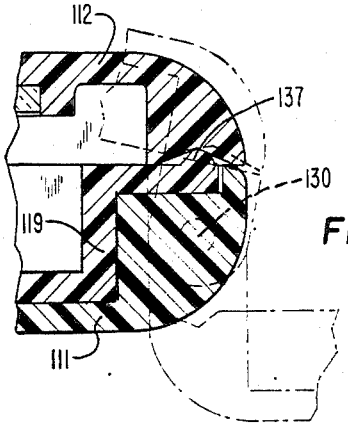
Figure 31:
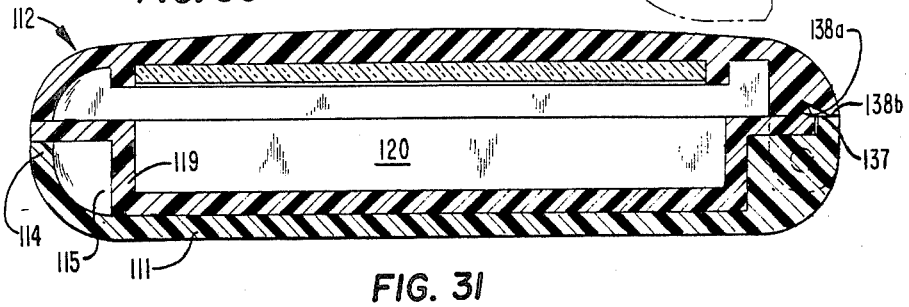

FIG. 31—is a vertical section taken on line 31—31 of FIG. 27.

FIG. 31*a*—is a partial enlarged view of the hinge and boss assembly shown partially opened end of the compact shown in FIG. 30 with the cover opened in phantomized dashed lines and fully opened in phantomized dot dashed lines.

Figure 32:
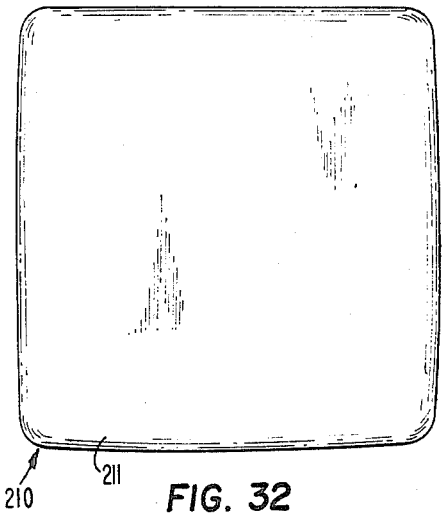

FIG. 32 is a top plan view of a compact in accordance with still another form of the present invention.

Figure 33:
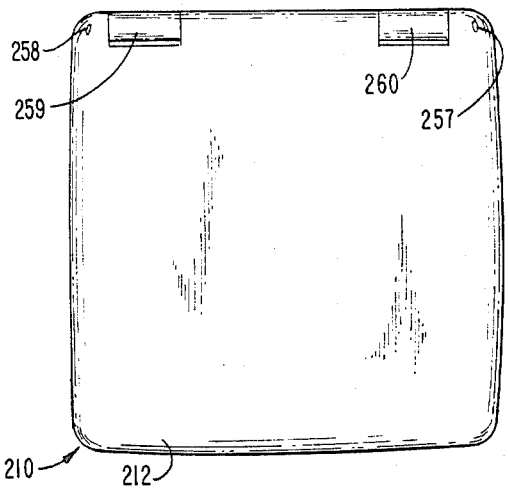

FIG. 33 is a bottom plan view of the compact shown in FIG. 32.

Figure 34:
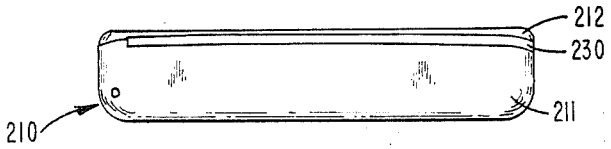

FIG. 34 is a side view of the compact shown in FIG. 32.

Figure 35:
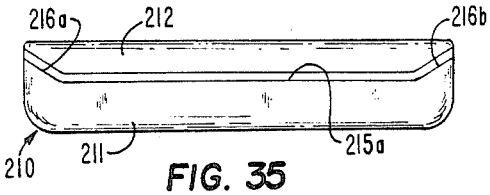

FIG. 35 is a front view of the compact shown in FIG. 32.

Figure 36:
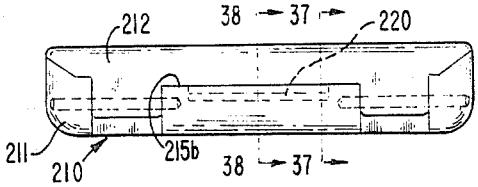

FIG. 36 is a back view of the compact shown in FIG. 32.

Figure 37:
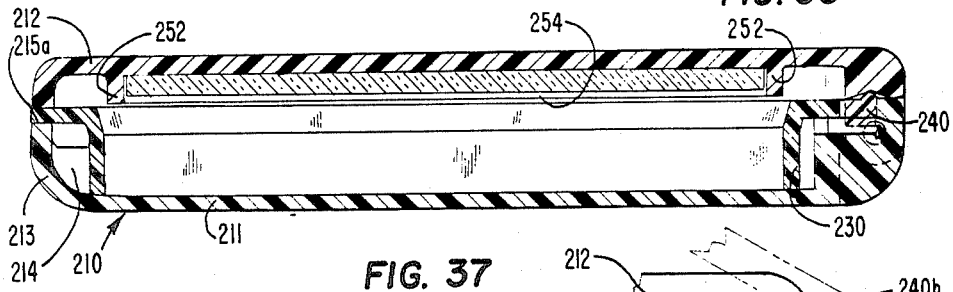

FIG. 37 is a vertical cross-section of the compact taken on line 37—37 of FIG. 37.

Figure 38:
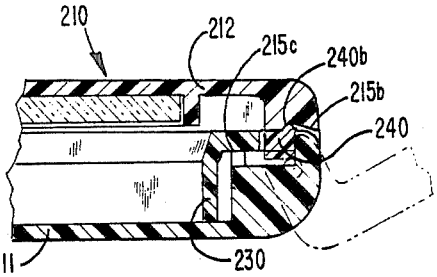

FIG. 38 is a vertical cross-section of the compact taken on line 38—38 of FIG. 36 showing the cover in phantomized dot dashed lines in the fully open position.

Figure 39:
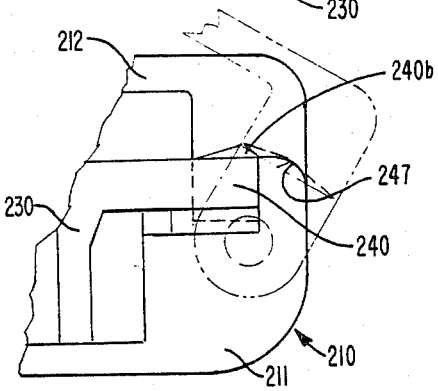

FIG. 39 is a partial enlarged view of the hinge and boss assembly end of the compact shown in FIG. 37 with the cover partially opened in phantomized dashed lines.

Figure 40:
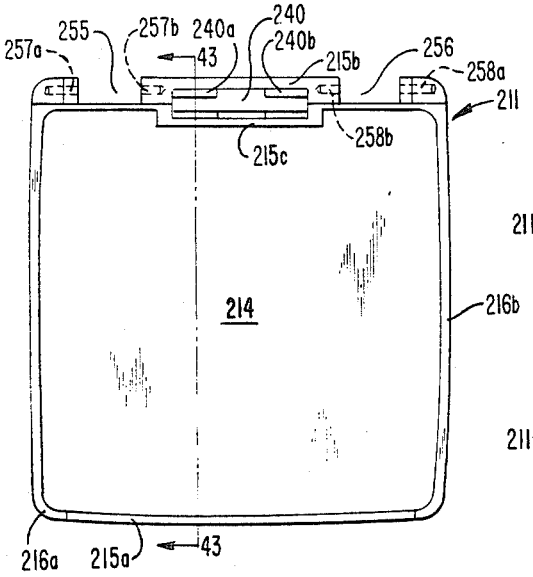

FIG. 40 is a top plan view of the base member for the compact shown in FIG. 32.

Figure 41:
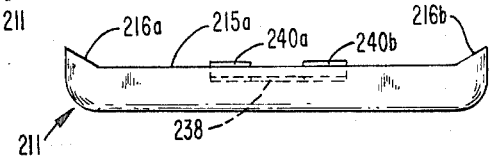

FIG. 41 is a front elevational view of the base member shown in FIG. 40.

Figure 42:
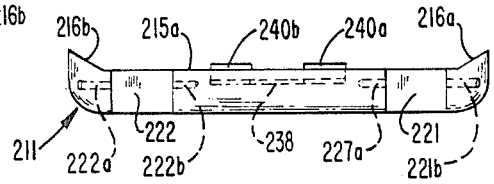

FIG. 42 is a rear elevational view of the base member shown in FIG. 40.

Figure 43:
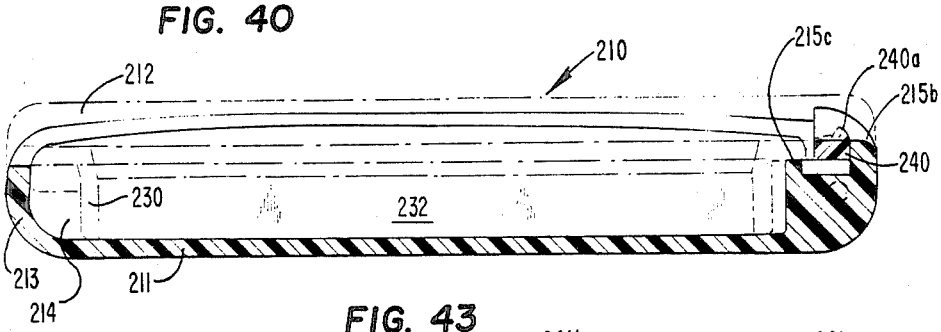

FIG. 43 is a vertical cross-section taken on line 43—43 of FIG. 40 with the cover member and platform member shown in phantomized dot dashed lines.

Figure 44:
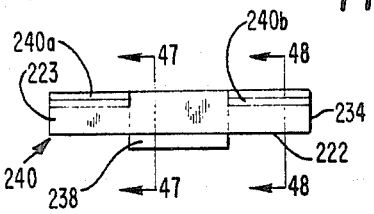

FIG. 44 is a top view of the boss member for the form of the present invention shown in FIGS. 32 to 43.

Figure 45:
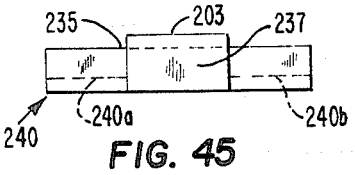

FIG. 45 is a bottom view of the boss member shown in FIG. 44.

Figure 46:
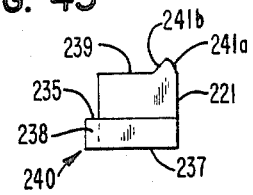

FIG. 46 is a right side view of the boss member shown in FIG. 44.

Figure 47:
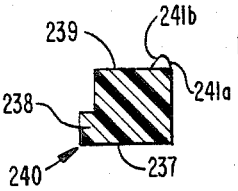

FIG. 47 is a cross-section of the boss member taken on line 47—47 of FIG. 44.

Figure 48:
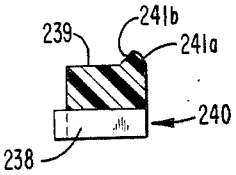

FIG. 48 is a cross-section of the boss member taken on line 48—48 of FIG. 44.

Figure 49:
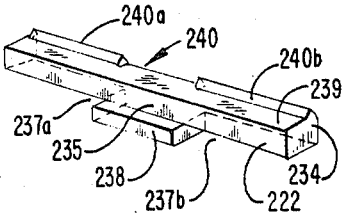

FIG. 49 is a perspective view of the boss member shown in FIG. 40.

Figure 50:
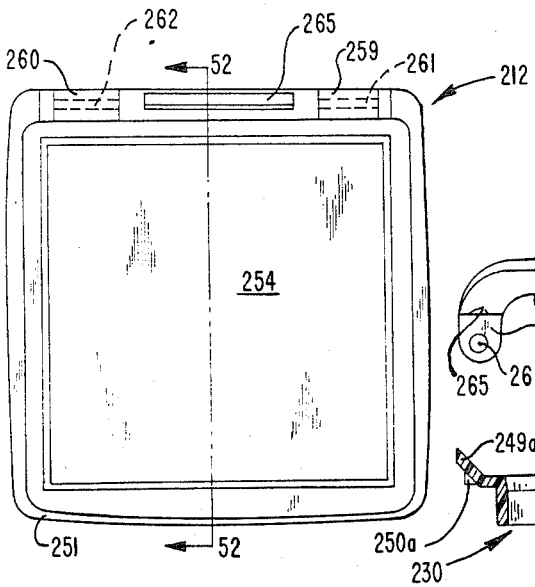

FIG. 50 is a bottom plan view of the cover member for the compact shown in FIG. 32.

Figure 51:
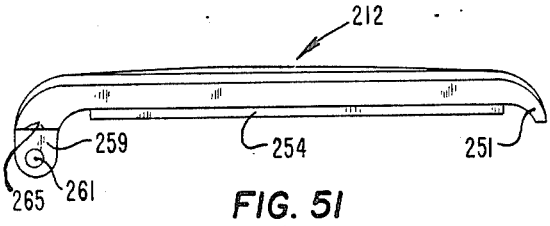

FIG. 51 is a side elevational view of the cover member shown in FIG. 50.

Figure 52:
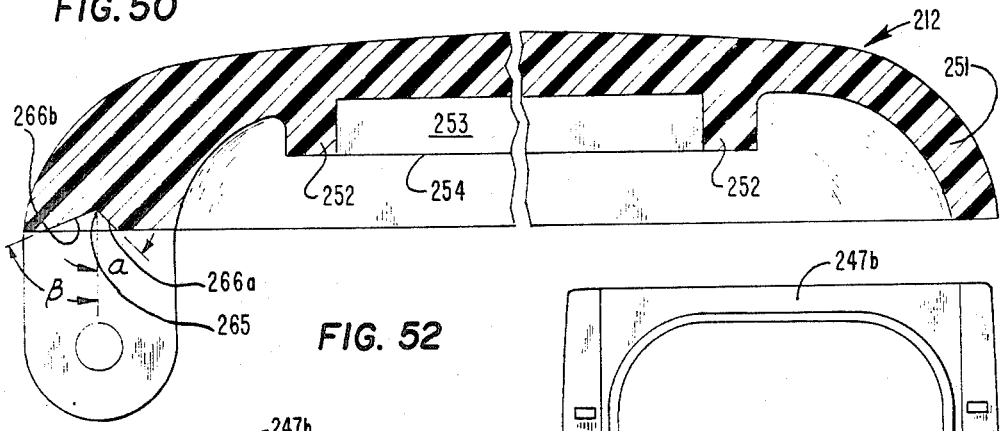

FIG. 52 is a vertical cross-section of the cover member taken on line 52—52 of FIG. 50.

Figure 53:
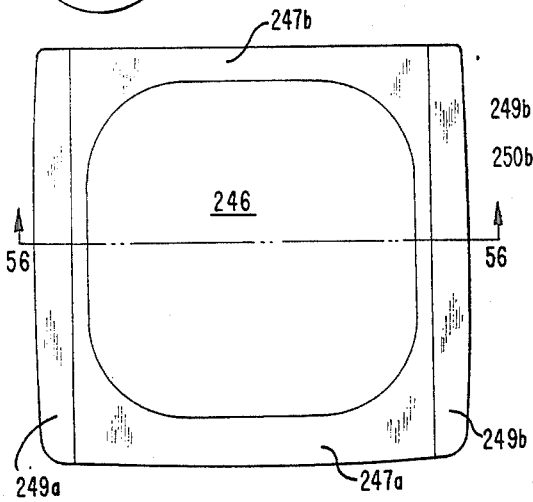

FIG. 53 is a top plan view of the platform member for the compact shown in FIG. 32.

Figure 54:
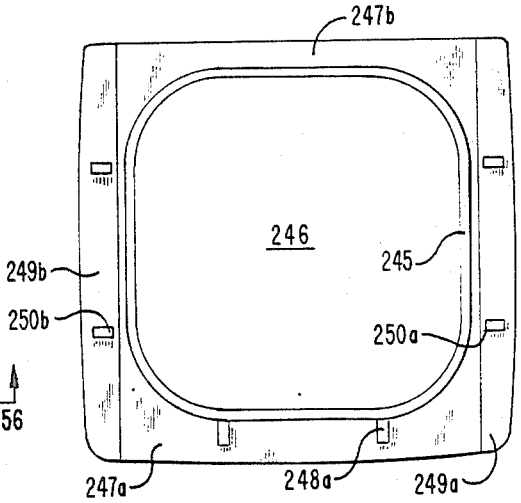

FIG. 54 is a bottom plan view of the platform member for the compact shown in FIG. 32.

Figure 55:
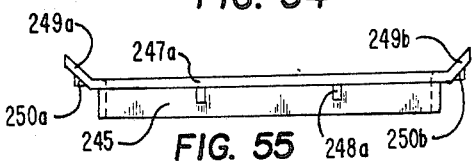

FIG. 55 is a front elevational view of the platform member shown in FIG. 53.

Figure 56:
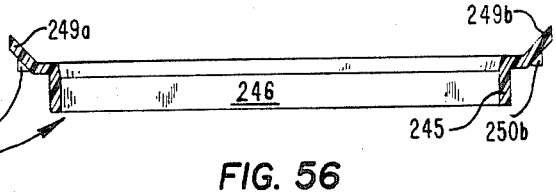

FIG. 56 is a vertical cross-section of the platform member taken on line 56—56 of FIG. 53.

DESCRIPTION OF ONE EMBODIMENT OF THE INVENTION

Referring to the drawings FIGS. 1 to 25 illustrate one form of the hinge and boss assembly forming an improved latch for containers in accordance with the present invention in which the container is shown in the form of a compact generally designated 10.

It will be understood by those skilled in the art that while the present invention is being illustrated as applied to compacts for rouge, powder or other cosmetics, that it is equally applicable to any type of closure in which a designed resistance to movement of the closure from the closed to opened position and vice versa is required to eliminate the need for a conventional front clasp heretofore used by prior art device.

Further, while the compact illustrated is square in plan view it will be understood by those skilled in the art that the shape and size of the particular container which utilizes the hinge and boss assembly in accordance with the present invention may have any shape which will meet the commercial requirements for devices of this type.

Figure 6A:
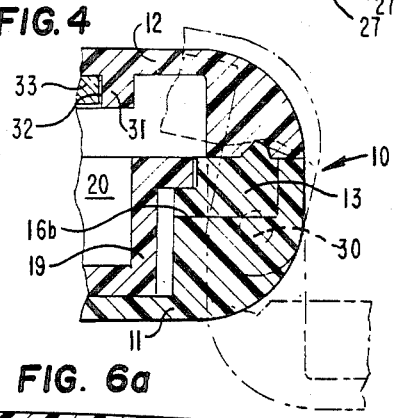
FIG. 6*a*—is a partial enlarged view of the hinge and boss assembly end of the compact as shown in FIG. 6 with the cover shown partially opened in phantomized dashed lines and fully opened in phantomized dot dashed lines.

Compact 10 is shown in FIGS. 1 to 25 as having a base or bottom member 11 and an associated matching and mating closure or top member 12 which is connected to the base member so that it can pivot from a fully closed to a fully open position and vice versa as is shown by FIGS. 6*a* of the drawings.

Connected in the base member 11 is a boss member 13 which coacts with the closure member to provide a concealed clasp means which has the designed resistance to movement of the closure member 12 from open to closed position, acts to in the closed position relative the base member 11, and provides the predetermined resistance to opening movement of the closure member 12 from said closed position.

The base 11 and closure 12 are preferable molded from plastic materials such as acrylonitrile styrene (SAN). The boss member 13 is preferably molded of dissimilar plastic material of a greater hardness such as acrylonitrile-butadiene-styrene (ABS) and polycarbomate having strength to stress the resilient plastic of the lesser hardness and more resilient materials used for the base member 11 and the closure member 12 respectively.

The nature and character of the material for the boss member 13 has bearing in all forms of the present invention as hereinafter described because it provides a means for preventing malfunction of the clasp means in that it will prevent undue wear of the boss member 13 during the anticipated functional life of the compact 10 on which this type of clasp means is provided.

Now referring further to FIGS. 3 to 12 of the drawings, the base or bottom member 11 is shown as cup shaped in cross section and the circumferential wall means 14 defines a chamber or space 15 which is open at its upper end. The circumferential wall means has a flat upper front center sections as at 16*a* and flat upper back center section 16*b* as shown at FIGS. 3, 4, 5, 8, 9, 11 and 12, and spaced at upper angled side sections as at 17*a* and 17*b* which diverge from the front flat center section 16*a* and the back flat center section 16*b*. The shaped circumferential flat upper surface side angled section 17*a* and 17*b* and the front center section and back center section 16*a* and 16*b* coact and support an intermediate insert or platform member 19 which defines a chamber or receptacle 20 open at its upper end to receive powder rouge or granular cosmetics and also acts in this form of the invention to hold the boss member 13 in assemble position. Further the inert on platform member 19 coacts with the closure or top member 12 to seal the chamber or receptacle 20 when the closure 12 is pivoted to the closed position.

In order to pivotally connect the closure member 12 to the base or bottom member 11, the base or bottom member 11 is shown as having spaced hinge openings as at 21 and 22 on the rear or back side of the base member 11. Extending transversely of the hinge openings 21 and 22 are hinge pin bores 21*a* and 21*b* for hinge opening 21 and 22*a* and 22*b* for hinge opening 22.

The coacting closure member shown in FIGS. 16 to 21 as substantially hemispherical in cross section with a circumferentially formed wall means 23 which like the base member has a lower surface having a front center section 24*a* and back center section 24*b*, and angled side sections 25*a* and 25*b* which diverge outwardly from the front and back center sections 24*a* and 24*b*. The angled side sections 25*a* and 25*b* will be matched to the front center section and back center section 16*a* and 16*b* and angled side sections 17*a* and 17*b* of the base member 11 so that the intermediate insert or platform member 19 is in assembled position on the base member 11 as hereinafter described. The flat lower surface on the closure member will intimately engage and seal the compact 10 in the closed position.

The closure or top member is further shown as having downwardly depending hinge members 26 and 27 which will be spaced on centers which correspond with the centers of the spaced openings 21 and 22 so that a transverse pin bore as at 26*a* for hinge member 26 and 27*a* for hinge member 27 will be in alignment with the pin receiving bores 21*a* and 21*b* for hinge opening 21 and 22*a* and 22*b* for hinge opening 22 to permit a pin or axle 28 to be inserted through the pin receiving bores 21*a*, 26*a* and 21*b* for the hinge element 26 and pin or axle 30 will be inserted through the pin receiving bores 22*a*, 27*a* and 22*b* for the hinge member 27 to allow the closure or top member 12 to pivot or swing through an arc of rotation of more than 180° to permit free access to the contents of the compartment or receptacle 20.

Inwardly of the circumferential wall 23 the closure member 12 is provided with a circumferential partition 31 which defines a space 32 in which a mirror as at 33 can be mounted. Thus, when the closure or top member 12 is moved to the open position, access is also obtained to the mirror 33.

In all forms of the present invention illustrated herein, no conventional interference clasp is provided at the front end of the compact in order to seal the receptacle 20 formed by the intermediate insert or platform member 19 in the compact 10. In the form of the invention shown in FIGS. 1 to 25, sealing is accomplished by a concealed clasp assembly by coacting between the hinge means above described, the boss member 13, and the closure or top member 12 of the compact.

Thus by reference to FIGS. 6, 6*a*, 7, 10, 13, 14 and 15 the base member 11 is shown as having a shaped and sized slot 35 cut into the upper surface of the flat center section 16*b* of the wall means 14. The slot 35 is elongated and disposed between the spaced hinge openings 21 and 22 and provides the means for mounting the boss member 13 therein. Boss member 13 is held in assembled position in the slot 35 by any suitable adhesive and by the intermediate insert or platform 19 which overlaps a front projecting flange portion 36 formed by the boss member as is clearly shown in FIGS. 10 and 15 of the drawings. Boss member 13 is an elongated member approximately square in cross section and is shaped on the back side thereof to snugly fit and engage the slot 35 in the back section 16*b* of the circumferential wall 14 so that in assembled position the upper face of the boss 13, except for a protuberance 37 is even with the back upper center section 16*b* of the circumferential wall 14 of the base member 11. The upwardly projecting protuberance 37 is shaped to provide a quarter round back section 37*a* and an angled front section 37*b* continuous therewith to enable the protuberance to coact with a groove 38 formed in the closure or top member 12, all of which is shown in FIGS. 7 to 21 of the drawings.

The groove 38 formed in the flat back center section 24*b* of the closure or top member 12 extends between the depending hinges 26 and 27. Further, the groove 38 is shaped to provide a first front angled side 38*a* at an angle $\alpha$ and a second back angled side 38*b* at an angle $\beta$ with respect to a center line extending through the pin receiving openings 26*a* and 27*a* for the respective depending hinges 26 and 27 on the closure 12. The angle $\alpha$ for the angled side surface 38*a* of the groove 38 will be such that it will require the exertion of a predetermined closing force to move this inner angled surface 38*a* over the quarter round section 37*a* of the protuberant 37 during closing movement of the closure or top member 12 with respect to the base member 11. When this predetermined closing force is exerted on the closure member 12, the nature of the plastic material from which the closure or top member 12 is made being more resilient will compress and distort until the inner angled surface 38*a* of the groove 38 is moved past the highest point to the back quarter round section 37*a* of the boss member, afterwhich the inner front angle section 38*a* will move into sliding and mating engagement with the front angle section 37*b* of the protuberance 37. The groove 38 having a depth such that the closure member can now continue to close until it meets and engages the intermediate member 19 disposed between the base member 11 and the closure member 12, as will be hereinafter described. When this occurs, an audible click can be heard and then because the depth of the groove 38 is at least equal or greater to the height of the protuberance 37 as the inner front angled surface 38*a* moves into the front angled section 37*b* of the protuberance the back angled surface 38*b* of the groove will simultaneously engage in generally line contact with the quarter round section 37*a* of the protuberance 37 in which position the coacting protuberance 37 and groove 38 now act to maintain the closure or top member 12 in engaged or closed position with respect to the receptacle or chamber 20 formed in the intermediate insert or platform member 19, all of which is shown in FIGS. 7 to 21 of the drawings.

Figure 6:
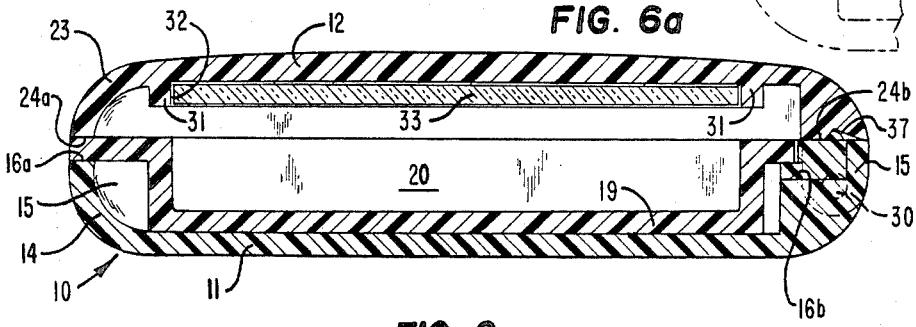
FIG. 6—is a vertical cross-section taken on line 6—6 of FIG. 4.

It will be apparent by reference to FIGS. 6, 6*a*, 19 and 21 that the angle $\alpha$ of the front angle surface 38*a* is more acute than the angle $\beta$ for the surface 38*b* and the reason for this is to reduce the initial opening force required to move the closure or top member 12 from the closed position to the open position. Thus, when it is desired to open the closure 12 the user inserts a fingernail or the end of the finger into engagement with the front end of closure 12 and can force it slightly open because of the line contact which exists between the back angled surface 38*b* with the half round back surface 37*a* of the protuberance 37. However, in order to move the closure member to the full open position it is now necessary once again to exert the predetermined force to move the front angled section 37*a* over the uppermost section of the protuberance 37 and once again when this force is exerted the back center section 24*b* will compress and distort because of the natural flexible resistance of the material from which the closure member is made until the front angled section 38*a* passes over the highest point of the protuberance 37 at which time there will be an audible clicking sound and then the closure 12 can be moved easily to the open position as is shown in FIG. 6 and 6*a* of the drawing.

Thus, by the coaction between the angled surface 38*a* and 38*b* of the groove 38 and the angled front surface 37*a* and quarter round back surface 37*b* of the protuberance 37, the coefficient of elasticity and memory characteristics of the material from which the closure 12 is made, the relative length of the depending hinges 26 and 27 and the moment of forces established by the length of the front section of the closure 12 from the axis of rotation of the depending hinges 26 and 27, it is possible to establish the predetermined forces required for closing the compact 10 for maintaining the compacting 10 closed, and for opening the compact.

Now referring to FIGS. 22 to 25, intermediate insert or platform member 19 is shown as being shaped and formed to fit into snug engagement with the base member 11. For this purpose, base member 11 is provided with spaced connecting post as at 40*a*, 40*b*, 40*c* and 40*d* shown at FIGS. 7, 10, 11 and 12 and the intermediate insert or platform member 19 is provided with corresponding bores as at 40*a*, 40*b*, 40*c* and 40*d* as shown in FIGS. 22, 23 and 25 on centers which will align with the connecting post 40*a*, 40*b*, 40*c* and 40*d* when the intermediate insert or platform member 19 is fitted onto the base member 11.

As further shown by these FIGURES, the intermediate insert or platform member 19 has a circumferential flange as at 42 which has a front flat center section 43*a* and a back flat center section 43*b* and angle side sections as at 44*a* and 44*b*, the side sections 44*a* and 44*b* being at an angle such that when the intermediate insert or platform member 19 is fitted onto the connecting post that the front flat section 43*a*, back flat section 43*b* and angled side sections 44*a* and 44*b* engage, match and mate with the corresponding front flat upper sections 16*a* and 16*b*, and 17*a* and 17*b* of the base member, the intermediate insert or platform member being held in this assembled position as by any suitable adhesive such as an epoxy adhesive.

It will be noticed that the back section 43*b* of the circumferential flange 42 fits over the front flange 36 of the boss member 13 so that the uppermost face of the flat back center section 43*b* will be in alignment with the uppermost face 16*b* of the back flat center section of the base member 11. Thus, when the closure member 12 is moved to the closed position as shown in FIG. 6 the front end and back end of the lowermost face of the circumferential wall 23 of the closure member 12 will engage the uppermost face of the circumferential flange 42 and the boss member 13 to seal the receptacle or chamber 20 when the compact in the closed position as shown in FIG. 6.

OPERATION OF THIS EMBODIMENT OF THE INVENTION

In operation, after the closure or top member 12 is pivotally connected to the base member 11 so that it is free to rotate from the fully open to the fully closed position, the boss 13 is fixed into the slotted section 35 and the intermediate insert or platform member 19 is then connected into position which permits the receptacle chamber or compartment 20 to be filled with the desired cosmetic.

The closure 12 can now be pivoted in a direction to close the compact and this will bring the groove 38 into contact with the protuberance 37 which requires exertion on the closure 12 to move the closure to the closed position as was above described.

After the closure member 12 is moved so that the angled side face 38*a* of the groove 38 passes the highest point of the protuberance 37 and the audible clicking sound is heard, the angled face 38*a* and the corresponding angled face 37*a* of the protuberance will move into mating engagement for maintaining the lower face of the circumferential wall 23 in engagement in the closed position.

When it is desired to open the closure member 12 a fingernail or the finger is forced against the front section of the closure member and by reason of the line contact between the angled section 38*b* of the groove 38 and the quarter round section 37*b* of the protuberance 37. The closure 12 will tend to move to open position. However, it is clear that a predetermined force must be exerted to move the closure member further because the front angle side 38*a* of the groove 38 must be moved over the uppermost portion of the protuberance 37 in order to enable the closure 12 to be moved to the fully open position as shown in FIG. 6*a* to provide access to the compartment or receptacle 20 and the mirror 33 to enable use of the compact 10.

When it is desired to close the compact, the closure member is again pivoted toward the closed position and the predetermined required force exerted as has been above described. This process can be repeated for opening and closing the compact and due to the fact that the boss member of a harder material than the base member or closure member. It will withstand the normal wear and tear of opening and closing the compact without producing any mechanical failure.

DESCRIPTION OF ANOTHER EMBODIMENT OF THE INVENTION

In FIGS. 26 to 31 of the drawings a compact generally designated 110 having another form of hinge and boss assembly for providing a concealed latch is illustrated.

In this form of the invention the compact 110 is also rectangular in plan view but those skilled in the art will understand that the shape and size of the compact can be varied without departing from the scope of the present invention. Further, as in the first form of the invention described, the compact 110 will be molded from plastic materials having the strength and thermoplastic memory required for the desired operation in accordance with the present invention.

Thus, referring to the FIGURES, the compact 110 has a base 111 and a closure or top member 112 which are operatively and pivotally connected to each other by means of the same type of hinge assembly described above for the first form of the invention. The base 111, as in the first form of the invention includes circumferential wall means 114 which defines a chamber or space 115. Wall means 114 has a front flat central section 116*a* and a back flat center section 116*b* and angled side sections as at 117*a* and 117*b* to which the cover member 112 will be matched and mated in the same manner as above described for the first form of the invention.

Further, by reference to FIGS. 28, 28*a*, 31 and 31*a* the base 111 is shown as having an elongated slot as at 135 in the flat back section 116*b* of the circumferential wall means 114 which is disposed between the spaced hinged openings 121 and 122 on the base member.

This form of the invention differs from the form of the invention first described in that the intermediate insert or platform member generally designated 119 which defines a receptacle or compartment 120 for powder rouge and the like type of granular cosmetics, has a backwardly extending projection 142*a* on the circumferential annular flange 142 formed on the intermediate insert or platform member 119 which as in the case of the first form of the invention has the matching and mating front flat center section 143*a* and the flat back center section 143*b* and the angled side sections 144*a* and 144*b* which as shown in FIG. 28*a* will be matched and mated to the base member when the intermediate insert or platform member 119 is fixed into assembled position on the base member. The said backward projection 142*a* fitting into the slot 135 to fix the upwardly extending protuberance 137 into position in alignment with the axle members on which the depending hinges of the cover member 112 will be pivotally connected.

Thus, in this form of the invention the boss member with the protuberance thereon is formed integrally with the intermediate insert or platform member 119 providing the same type of assembly and operation as above described for the first form of the invention.

Thus the protuberance 137 includes the front angle face 137*a* and the quarter round back section 137*b* which is adapted to coact with the groove means 138 and the corresponding angle front side face 138*a* and angled back side face 138*b*. The angled side faces 138*a* and 138*b* being at the same angles $\alpha$ and $\beta$ as above described for the first form of the invention.

OPERATION OF THE SECOND FORM OF THE INVENTION

By reference to FIGS. 31 and 31*a*, the closure or top member 112 is shown as moving from the open to the closed position on the base member 111. When this occurs the angle side surfaces 138*a* and 138*b* of the elongated groove 138 are brought into contact initially with the quarter round surface 137*b* on the protuberance 137 formed at the back section 142*a* of the intermediate member 119. Since this interferes with the continued closing movement of the closure member 112, additional force must be exerted on the front section of the closure member to force the closure member so that the angled side surface 138 of the elongated groove continues to move until it reaches the highest point of the protuberance 137 at which point the said angled side surface 138*a* will ride over the protuberance and as the closure 112 is moved to the closed position in the same manner as above described for the form of the invention shown in FIGS. 1 to 25 the said angle side face 138*a* will be brought into contact and mating engagement with the angled side face 137*a* on the protuberance 137 where they exert a counterforce on each other so as to maintain the closure 112 in the closed position.

In this position the angled side face 138*b* will be in contact with the quarter round surface 137*b* on the protuberance 137 and since the angle is less acute for the angled side face 138*b* than the angled side face 138*a*: it will be clear that when it is desired to move the closure member 112 to open position that this angled side face will ride easily over the quarter round surface 137 initially until it is necessary to exert force to move the angled side face 138*a* over the uppermost portion of the protuberance 137 on the side of the angled side face 137*a*. This requires exerting some force until the highest point is reached, at which point the closure member 112 can be pivoted to any open position including the full open position as shown in FIG. 31*a*.

As the closure 112 is moved to the closed position or to the open position as above described, an audible click or snapping sound will be heard.

The closing and opening procedure as above described can be followed whenever the user desires to seal the chamber or receptacle 120 or to open the compact for access to the cosmetics stored in the chamber or compartment 120 in the intermediate section 119. The hinge and boss assembly in this form of the invention also provides various ways in which the non-resiliency of the protuberance 137 and the forces exerted can be adjusted between relatively wide variations for containers of this type. This is desirable in the case of compacts for cosmetics because the hinge and boss assembly can be concealed and this improves the external appearance of the compact. It is clear however that the design of the angled side surfaces 138*a* and 138*b* of the elongated groove 138 and the coacting angled side surface 137*a* and quarter round surface 137*b* of the protuberance 137 are designed to provide a predetermined resistance to closing when the closure member 112 is being rotated and moved for engagement with the intermediate member 119 in the base member 111. Conversely, these same angled surfaces are designed to permit initial opening followed by predetermined resistance to opening when the closure member is being pivoted from closed to open position.

DESCRIPTION OF STILL ANOTHER EMBODIMENT OF THE INVENTION

Referring now to FIGS. 32 to 56 of the drawings which illustrate a container representing a still further embodiment of the present invention in the form once again of a compact generally designated 210.

In this species of the invention the compact 210 has a base member 211 and a closure member 212 pivotally connected to each other by means of still another form of hinge and boss assembly. Compact 210 also includes, the intermediate insert or platform member 230 affixed within the base member 211 and a boss or insert member 240 affixed and disposed in the base member 211 for operative coaction with the closure member 212 as will be more fully described below.

Although the container is shown as a square in plan view, it is again noted that those skilled in the art will readily understand that any particular container made in accordance with the present invention may take any shape or size so as to meet the present commercial requirements for devices of this type.

The base member 211 and the closure member 212 are preferably molded from plastic material having a strength and thermal plastic memory similar to that of acrylonitrile styrene (SAN). The boss member 240 and the platform member 230 are preferably molded of a dissimilar plastic material of a greater hardness such as acrylonitrile-butadiene-styrene (ABS) and polycarbomate having sufficient strength to stress the more resilient plastic of lesser hardness and more resilient materials used for the base member 211 and the closure member 212.

The base member 211 has a circumferential wall 213 which defines a receptacle or space 214. The upper face of the circumferential wall 213 forms a generally flat front central surface 215*a*, a back central surface 215*b*, and spaced beveled side surfaces 216*a* and 216*b* which diverge away from the front central and back central surfaces 215*a* and 215*b* as is clearly shown in FIGS. 40, 41 and 42 of the drawings.

A stepped section as at 215*c* is shown on the inner section of the back central section 215*b*. Additionally, the front central section is sized and continuous with the respective diverging side sections 216*a* and 216*b* so that when the intermediate insert or platform member 230 is in assembled position, the front central section and side central sections will engage the under surface of the intermediate insert or platform member 230. Conversely, at the back central section 215*b*, two separate spaced angled and diverging side shoulders are formed as at 217*a* and 217*b* so that corresponding shoulders are formed as at 218*a* and 218*b* so that when the intermediate insert or platform member 230 is fitted inside the base member 211 as is more fully described hereinafter, the side edges of the intermediate insert or platform member 230 engage the stepped section 215*c* and the upper faces of the intermediate insert or platform member 230 engage and align with the space diverging side sections 216*a* and 216*b*, all of which is clearly shown in FIGS. 34, 36, 37, 40, 41 and 43.

The base member 211 also has a retaining slot 220 formed in the back central surface 215*b* of the circumferential wall 213 of the base member 211 for mounting the boss member 240 therein.

Boss member 240 is an elongated member sized to snugly engage in the retaining slot 220 and thus has a generally flat back section 221 and a front section 222 spaced therefrom and end portions 223 and 224 so that the boss member not only fits easily into the retaining slot 220, but provides adequate surfaces in the event that it is desired to adhesively affix the boss member in assembled position in the slot. Further, FIGS. 44 to 49 show that the front face 222 is milled or cut as at 235 so that the front face is in alignment with the shelf-like shoulder 215*c* formed on the inner side of the flat back central section 215*b* of the base member 211.

Further, FIGS. 43 to 49 show that the bottom 237 of the boss member 240 are undercut on opposite sides as at 237*a* and and 237*b* so that they form a centrally projecting tab as at 238 which is continuous with the bottom 237 and acts to provide a sufficient portion of the front face 222 to hold the boss member in the retaining slot 220.

On the upper face 239 of the boss member two spaced upwardly extending protrusions are provided as at 240*a* and 240*b*, which members are in spaced relation to each other although those skilled in the art will readily recognize that the members 240*a* and 240*b* could be joined together as a single member without departing from the scope of the present invention.

The protrusions 240*a* and 240*b* will coact with the closure member as will be hereinafter described.

The protrusions 240*a* and 240*b* are provided respectively with a quarter round back surface as at 241*a* and 241*b* and an angled front surface as at 242*a* and 242*b* for purposes that will appear clear from the operation of this form of the invention as hereinafter described.

Also mounted in the base member 211 for operative association with the boss member is the intermediate insert or platform member 230. Platform member 230 includes an annular wall 245 which defines a chamber 246 for powder rouge or the like type of granular cosmetics. About the annular wall 245 a continuous flange is formed consisting of a front flat central flange section 247*a*, a flat back central section 247*b* and diverging side sections 248*a* and 248*b* which are shaped and sized for matching and mating engagement with the front flat central section 215*a*. the flat back central section 215*b*, and diverging side sections 216*a* and 216*b* of the base member when the intermediate insert or platform member 230 is placed in assembled position in the base member 211 as is shown in FIGS. 34, 35, 37, 38, 39 and 43.

Further, FIGS. 54, 55 and 56 show that the intermediate insert or platform member 230 is provided with underside tabs as at 248 under the front flat central section 247*a*, and 250*a* and 250*b* under the respective diverging angled side section 249*a* and 249*b*. These underside tabs act to strengthen and support the intermediate insert or platform member 230 within the receptacle or space 214 formed in the base member 211. The intermediate insert or platform member 230 may be adhesively connected as by a suitable epoxy or like type of adhesive so that it rests on the bottom of the base member 211 and engages the associated upper faces and shoulders on the base member as above described.

The closure member 212 is pivotally connected to and operatively associated with the base member 211 by means of the improved hinge and boss assembly in accordance with this form of the invention so that it can pivot alternately to an open position to permit access to the chamber or cosmetic compartment 246 and to the closed position when not in use so as to seal this chamber or compartment.

Thus, the closure member 212 in this further embodiment of the invention is also hemispherical in shape and therefore has a circumferential rim 251 so shaped that the lower surface thereof in the closed position coacts with the upper face of the flange flat front central section 247*a*, the flat back central section 247*b* and the diverging angled side section 249*a* and 249*b* of the intermediate insert or platform member 240 to seal the compartment or space 246.

Further, the closure member 212 has an annular partition 252 a space distance inwardly of the circumferential rim 251 to define a cavity 253 for various purposes such as the mounting of a mirror 254 for use when the closure member 212 is pivoted to the fully open position relative the base member 211 as shown in FIGS. 38 and 39 of the drawing.

Further, the drawing shows that base member 211, enclosure member 212 are pivotally connected by pin type hinges wherein the respective hinge elements are molded as integral parts of the respective base member 211, closure member 212. Thus, formed at the back side of the base member 211 on the annular wall 213 are spaced hinge openings 255 and 256. Pin or axle bores 257*a* and 257*b* are provided transversely of the hinge opening 255 and pin or axle bores 258*a* and 258*b* are provided transversely of the hinge opening 256. The spaced openings are on opposite sides of the flat back center section 215*b* in which the retaining slot 220 is provided for mounting the boss member 240. The pin or axle bores 257*a*, 257*b*, 258*a* and 258*b* will be disposed in a predetermined vertical plain and a space distance from the boss member 240 to provide the operative coaction between the closure member 212 and boss member 240 as will be referred to hereinafter.

Similarly, as on the first form of the invention described, the closure member 212 has spaced hinge elements 259 and 260 so molded that they are on spaced centers identical to the spaced centers of the hinge openings 255 and 256 formed on the base member 211. The respective hinge elements 259 and 260 are continuous with the back edge of the closure member 212 and depend downwardly from the bottom of the circumferential rim 251 for a predetermined length to produce the desired coaction between the closure member and the boss member for the advantageous operative coaction of the base member with the closure member in this form of the invention. Pin or axle bores as at 261 for hinge element 259 and 262 for hinge element 260, when properly aligned will enable pins or axles 263 and 264 to fit into the respective pin openings and pin bores 257*a*, 261 and 257*b* and 258*a*, 262 and 258*b* so that the closure member 212 can pivot through an arc of rotation of more than 120°, which movement will provide free access to the compartment or chamber 246 holding the cosmetics and will permit use of the mirror 253 in the closure member 212.

In this species of the invention as is accomplished in the forms of the invention heretofore described there is no conventional front clasp for maintaining the closure member 212 in sealing engagement with the upper face of the intermediate insert or platform member 219. As in the earlier forms of the invention, this is accomplished by the coaction between an elongated sized and shaped groove 265 in the back edge of the circumferential wall 251 on the closure member 212. The elongated sized and shaped groove 265 is provided with oppositely disposed angled side surfaces as at 266*a* and 266*b*, which are respectively at angles $\alpha$ and $\beta$ with respect to a center line or plane which passes through the axial line for the pins or axles 263 and 264. For the hinge elements 259 and 260, about which the closure member 212 pivots when it moves arcuately from open to closed and closed to open position. The angle $\alpha$ is more acute than the angle $\beta$ to provide the same operation with the sized and shaped ridges 240*a* and 240*b* on the boss member 240 as was above described for the first form of the invention shown in FIGS. 1 to 25 of the drawing. More particularly, reference is made to the surfaces 37*a* and 37*b* of the protuberance 37 on the boss member 13 and the angled side faces 38*a* and 38*b* of the elongated groove 38 and the cover member 12 of the said first form of the invention.

However, in this third embodiment of the invention, because of the undercut sections 237 and 237*b*, the boss member 240 has a limited degree of resilience and thus on closing movement the closing member 212 is partly relieved from the full compression stress exerted at the top most contact point during closing movement as the angled face 266*a* moves across the quarter round surface 241*a* and 241*b* on the spaced protuberances or ridges 240*a* and 240*b* on the boss member 240. However, the coaction between the boss member 240 and the elongated groove 265 acts along with the coefficient of elasticity of the boss member and the cover member, the materials of which the elements of the compact are made and the moment of force from the front of the cover to the axis about which the hinge elements pivot to determine and/or adjust the predetermined force required to close the compact to maintain the seal and the compact closed and to adjust the predetermined force required to move the compound to open position.

OPERATION OF THE FURTHER EMBODIMENT OF THE INVENTION

In operation, as the closure member 212 rotates and moves from the open to the closed position the ridges 244*a* and 244*b* on the boss member 240 are engaged by the elongated sized and shaped groove 247 formed in the under surface of the circumferential rim 251 of the closure member 212. As the closure member 212 is pivoted further towards the closed position, angular surfaces 247*a* and 247*b* of the groove 247 will ride up and over the quarter round surface 245*a* on the boss member 240.

During such movement the boss member 240 is so engaged that a force is exerted on the ridges 240*a* and 240*b* to cause the undercut portions 237*a* and 237*b* to flex in slot 218 so as to limit bowing of the back center section of the closure member 212 between the hinge elements 223 and 224 as is shown in FIG. 39. Thus, any undue stress that would normally be experienced by this portion of the closure member 212 is relieved and absorbed in the boss member 240.

It is clear from the description of the movement of the closure member 212 from the open to the closed position that a predetermined force must be exerted for accomplishing this purpose. Once the closure member 212 is in the closed position and that predetermined force is removed, the boss member 240 will be fully engaged with the respective angled surfaces 266*a* and 266*b* of groove 265 to exert a counter force against the opening of the closure member 212 to maintain the same in the closed position as is shown in FIGS. 37 and 38.

As the closure member 212 is moved to the closed position or to the open position, the aforementioned audible click or snapping sound will be heard.

When it is necessary to open the compact 210 the user can insert a fingernail or the end of a finger into the front side of the compact 210 remote from the hinge and boss assembly and, by exerting a relatively light force; overcome the counterforce acting between the angled surfaces 266*a* and 266*b* of the groove 265 on the coacting surfaces 241*a* and 241*b* and 242*a* and 242*b* on member 240; and lift the closure member 212 from the closed to the open position.

The improved hinge and boss assembly of this embodiment of the invention provides various ways in which the resiliency of the closure member 212, and the forces exerted on the angled surfaces 266*a* and 266*b* of the groove 265 by the coacting surfaces on the ridges 240*a* and 240*b* of the boss member 240 can be adjusted between relatively wide variations for devices of this type.

The factors which have a bearing on this interrelationship of resiliency to force exerted is the coefficient of elasticity of the materials from which the closure member 212 and the base member 240 are made; the thermal memory of the closure member 212; the angles $\alpha$ and $\beta$ of the angled surfaces 266*a* and 266*b;* the relative length of the depending hinge elements 259 and 260; the moment of force as established by the length of the closure member 212; the height and width of the ridges 240*a* and 240*b* on the boss member 240; and the length of the undercut portions 237*a* and 237*b* on the boss member 240.

A particular feature of this species of the present invention is the design angles $\alpha$ and $\beta$ on the surfaces 266*a* and 266*b,* respectively, of groove 265 as is shown in FIG. 52.

Angle $\alpha$ is designed to provide a predetermined resistance to closing when the closure member 212 is moved relative to the boss member 240 as shown in FIG. 30. The resistance arises from the contact the arcuate portions 241*a* and 241*b* of the ridges 240*a* and 240*b* on member 240 exerts against the angled surface 266*b.* thus requiring a predetermined force to flex the undercut portions 237*a* and 237*b* and allow the closure member 212 to close upon the base member 211.

Similarly, angle $\beta$ is designed so that when the boss member 240 is fully engaged by and held within the groove 265 of the closure member 212, there is a predetermined resistance which must be overcome to move the closure member 212 to the fully open position as shown in FIG. 37.

While the foregoing description illustrates various preferred embodiments of apparatus and systems in accordance with the present invention, it will be appreciated that certain changes and modifications may be made in the structure of these disclosed arrangements without departing from the spirit and scope of the invention and that the same is defined by the claims as hereinafter set forth.

What is claimed is:

1. A concealed latch assembly for a closure member pivotally connected to a base member and movable from a closed position to a full open position and vice versa comprising, a. spaced hinge means including, hinge elements connected respectively to the closure member and the base member to permit movement of the closure member to a full open position, b. a boss member disposed between the hinge means so that a force must be exerted on the closure member during compressive forces on the closure member and the base member, c. said boss member made of a material generally harder than the material for the closure member and the base member; and d. the boss member alternatively and selectively sized and shaped to provide a predetermined range of resiliency from rigid and non-yielding to readily flexible as required for movement of the closure member from closed position to a full open position and vice versa.

2. A concealed latch assembly as claimed in claim 1 wherein, a. the boss member is disposed on the base, and b. the closure member has a sized and shaped groove on the operatively associated portion thereof coacting with the boss member.

3. A concealed latch assembly as claimed in claim 1 wherein, a. the boss member is inserted within the base, and b. the closure member has a sized and shaped groove on the operatively associated portion thereof coacting with the boss member.

4. A concealed latch assembly as claimed in claim wherein, the base member and the closure member are molded from plastic materials such as acrylonitrile styrene (SAN).

5. A concealed latch assembly as claimed in claim 4 wherein, the boss member is molded of dissimilar plastic materials from the base member and the closure member such as acrylonitrile-butadiene-styrene (ABS) and polycarbomate.

6. A concealed latch assembly for a closure member pivotally connected to a base member and movable from a closed position to a full open position comprises:

a. spaced hinge means including, hinge elements connected respectively to the closure member and the base member to permit movement of the closure member to a full open position;

b. a platform member positioned within the base member the closure member also comes into contact with the periphery of the platform member;

c. a boss member disposed on the periphery of the platform member that a force must be exerted on the closure member to overcome compressive forces on the closure member and the boss member; and d. said boss member made of a non-resilient material that is harder than the material for the closure member and the base member.

7. A concealed latch assembly as claimed in claim 6 wherein, the closure member has a sized and shaped groove on the operatively associated portion thereof coacting with the boss member.

8. A concealed latch assembly as claimed in claim 6 wherein, the base member and the closure member are molded from plastic materials such as acrylonitrile styrene (SAN).

9. A concealed latch assembly as claimed in claim 6 wherein, the platform member and the boss member are molded of dissimilar plastic materials from the base member and the closure member such as acrylonitrile-butadiene-styrene (ABS) and polycarbomate.

10. A concealed latch assembly for a closure member pivotally connectible to a base member and movable from a closed position to a fully open position and vice versa comprising, a. spaced hinge means wherein, the hinge elements connected respectively to the closure member and the base member permit the movement of the closure member to a fully open position;

b. a boss member disposed between the hinge means so that a force must be exerted on the closure member during movement thereof to overcome compressive forces on the closure member and the base member;

c. said boss member is made of a material that is harder than the material for the closure member and the base member; and d. said boss member having, means to permit the boss member to flex during closing movement of the closure member.

11. A concealed latch assembly as claimed in claim 10 wherein, a. the boss member is disposed on the base; and b. the closure member has a sized and shaped groove on the operatively associated portion thereof coacting with the boss member.

12. A concealed latch assembly as claimed in claim 10 wherein, a. the boss member is inserted within a slot in the base; and b. the closure member has a sized and shaped groove on the operatively associated portion thereof coacting with the boss member.

13. A concealed latch assembly as claimed in claim 10 wherein, the ends of the boss member will flex in order to prevent the closure member from bowing under stress.

14. A concealed latch assembly as claimed in claim 10 wherein, the base member and the closure member are molded from plastic materials such as acrylonitrile styrene (SAN).

15. A concealed latch assembly as claimed in claim 10 wherein, the boss members are molded of dissimilar plastic materials from the base member and the closure member such as acrylonitrile-butadiene-styrene (ABS).

16. A concealed latch assembly as claimed in claim 10 where the means on the boss member which permits the flexure thereof comprises, at least one undercut means.

17. A concealed latch assembly as claimed in claim 10 where the means on the boss member which permits the flexure thereof comprises, spaced undercut means disposed on each end of the boss member.

18. A concealed latch assembly as claimed in claim 10 where the means on the boss member which permits the flexure thereof, comprises, a center tab, and spaced undercut means on opposite sides of the center tab.

19. A concealed latch assembly as claimed in claim 10 wherein, a. said base member has a slot disposed on a stepped portion between the hinge means, b. said boss member comprises, a tab means disposed in the center portion thereof sized and shaped to fit within said slot, and undercut means for operative association with said slot.

20. A concealed latch assembly as claimed in claim 10 wherein, a. said boss member includes, ridge means on the outer face thereof; and b. said closure member includes, a sized and shaped groove to coact with said ridge means during the opening and closing movement thereof.

21. A concealed latch assembly as claimed in claim 10 wherein, a. said boss member includes, ridge means disposed on the outer face thereof, and tab means disposed on the inner face and in the center portion thereof; and b. said ridge means includes, two portions disposed respectively on opposite sides of said tab means.

22. A concealed latch assembly for a closure member pivotally connectible to a base member and movable from a closed position to a fully open position and vice versa comprising, a. spaced hinge means wherein, the hinge elements connected respectively to the closure member and the base member permit the movement of the closure member to a fully open position;

b. a boss member disposed between the hinge means so that a force must be exerted on the closure member during movement thereof to overcome compressive forces on the closure member and the base member;

c. said boss member is made of a non-resilient material that is harder than the material for the closure member and the base member;

d. said boss member having means thereon to permit the boss member to flex during the closing movement of the closure member; and e. a platform member positioned within the base member such that the closure member comes into contact with the periphery of the platform member when in the closed position.

23. A concealed latch assembly as claimed in claim 22 wherein, said platform member and said boss member are molded of dissimilar plastic materials from the base member and the closure member such as acrylonitrile-butadiene-styrene (ABS).

24. A concealed latch assembly as claimed in claim 22 wherein, said platform member defines a compartment therein.

25. A concealed latch assembly as claimed in claim 22 wherein, said platform member has a shaped flange for mated engagement with the periphery of the base member.

26. A concealed latch assembly as claimed in claim 22 wherein, a. said base member has a slot disposed on a stepped portion between the hinge means;

b. said boss member comprises, a tab means disposed in the center portion thereof sized and shaped to fit within said slot, and undercut means for operative association with said slot; and c. the lower face of back flange on said platform member rests on said stepped portion between the hinge means and on the upper face of the exposed section of the tab means.

* * * * *